United States Patent [19]

Thorn

[11] Patent Number: 4,922,674

[45] Date of Patent: May 8, 1990

[54] COMPRESSION MOLDED DOOR ASSEMBLY

[75] Inventor: John E. Thorn, Sylvania, Ohio

[73] Assignee: Therma-Tru Corp., Toledo, Ohio

[21] Appl. No.: 207,172

[22] Filed: Jun. 15, 1988

[51] Int. Cl.[5] ..... E04C 1/00; E04C 2/34

[52] U.S. Cl. ..... 52/309.15; 52/309.11; 52/802; 52/805

[58] Field of Search ..... 52/802, 803, 804, 805, 52/309.15, 309.11

[56] References Cited

U.S. PATENT DOCUMENTS

| | | | |
|---|---|---|---|
| 2,557,412 | 6/1951 | Clements | 52/803 |
| 2,707,808 | 5/1955 | Anderson | 52/805 |
| 2,849,758 | 9/1955 | Plumley et al. . | |
| 2,871,056 | 3/1958 | Levitt . | |
| 2,890,977 | 8/1959 | Bayer et al. . | |
| 2,924,860 | 9/1960 | Parham, Jr. et al. . | |
| 3,153,817 | 3/1965 | Pease, Jr. . | |
| 3,225,505 | 2/1968 | Lytz . | |
| 3,250,041 | 3/1969 | Anger . | |
| 3,299,595 | 1/1970 | Munk . | |
| 3,402,520 | 2/1971 | Lee et al. . | |
| 3,450,593 | 6/1969 | Fossier | 52/805 |
| 3,455,028 | 7/1969 | Brown | 52/802 |
| 3,498,001 | 6/1975 | MacDonald . | |
| 3,512,304 | 6/1976 | Meuret . | |
| 3,546,841 | 3/1973 | Smith et al. . | |
| 3,593,479 | 4/1974 | Hinds . | |
| 3,616,116 | 10/1971 | McDonald | 52/802 |
| 3,772,241 | 2/1975 | Kroekel . | |
| 3,883,612 | 3/1975 | Pratt et al. . | |
| 3,950,894 | 4/1976 | DiMaio . | |
| 3,961,012 | 6/1976 | DiMaio . | |
| 4,132,042 | 1/1979 | DiMaio . | |
| 4,152,876 | 3/1979 | Seely . | |
| 4,265,067 | 3/1980 | Palmer . | |
| 4,420,922 | 12/1983 | Wilson | 52/802 |
| 4,550,540 | 11/1985 | Thorn . | |

FOREIGN PATENT DOCUMENTS

| | | | |
|---|---|---|---|
| 898855 | 6/1980 | Belgium . | |
| 2304763 | 9/1988 | France . | |
| 462428 | 3/1951 | Italy | 52/802 |
| 604937 | 2/1977 | U.S.S.R. . | |
| 2044316 | 2/1970 | United Kingdom . | |
| 1487309 | 4/1971 | United Kingdom . | |
| 1420244 | 3/1975 | United Kingdom . | |

*Primary Examiner*—Henry E. Raduazo

*Attorney, Agent, or Firm*—Emch, Schaffer, Schaub & Porcello Co.

[57] ABSTRACT

A door assembly having at least one compression molded skin is disclosed. A rectangular frame is not required. Integral edge members extend from each of the top, bottom and side edges of the compression molded skin and are connected to a second skin. A core is positioned between said skins.

2 Claims, 4 Drawing Sheets

COMPRESSION MOLDED DOOR ASSEMBLY

BACKGROUND OF THE INVENTION

The present invention relates to a compression molded door assembly. Compression molded door assemblies comprise a separate class of doors. A prior art compression molded door assembly is disclosed in my U.S. Pat. No. 4,550,540, which was granted Nov. 5, 1985.

Compression molded door assemblies include outer compression molded door skins which have a textured pattern on the outer side of each skin which simulates, for example, grain and texture of a wood door.

The compression molded door assemblies are often superior to a wood door in that they have dimensional stability which resists excessive deflection and warping caused by temperature and humidity differentials.

SUMMARY OF THE INVENTION

The present invention is directed to a compression molded door assembly which does not include a rectangular frame found in most prior art compression molded doors.

The outer sides of the compression molded skins define a textured pattern simulating the grain and texture of a wood door. An integral edge member extends outwardly from major portions of the top, bottom and side edges of the door skins. The integral edge member mates with a similar integral edge member extending outwardly from the edges of the opposed compression molded skin.

The primary object of the present invention is to provide a compression molded door assembly that is both attractive and also has strength and dimensional stability.

Another object of the present invention is to provide a door assembly which is simple and economical to manufacture.

A further object of the present invention is to provide a door assembly which can utilize a number of different types of materials or structural configurations for the core.

Other objects and advantages will become apparent from the description and drawings.

DETAILED DESCRIPTION OF THE DRAWINGS

DETAILED DESCRIPTION OF THE PREFERRED EMBODIMENTS

Figure 1:
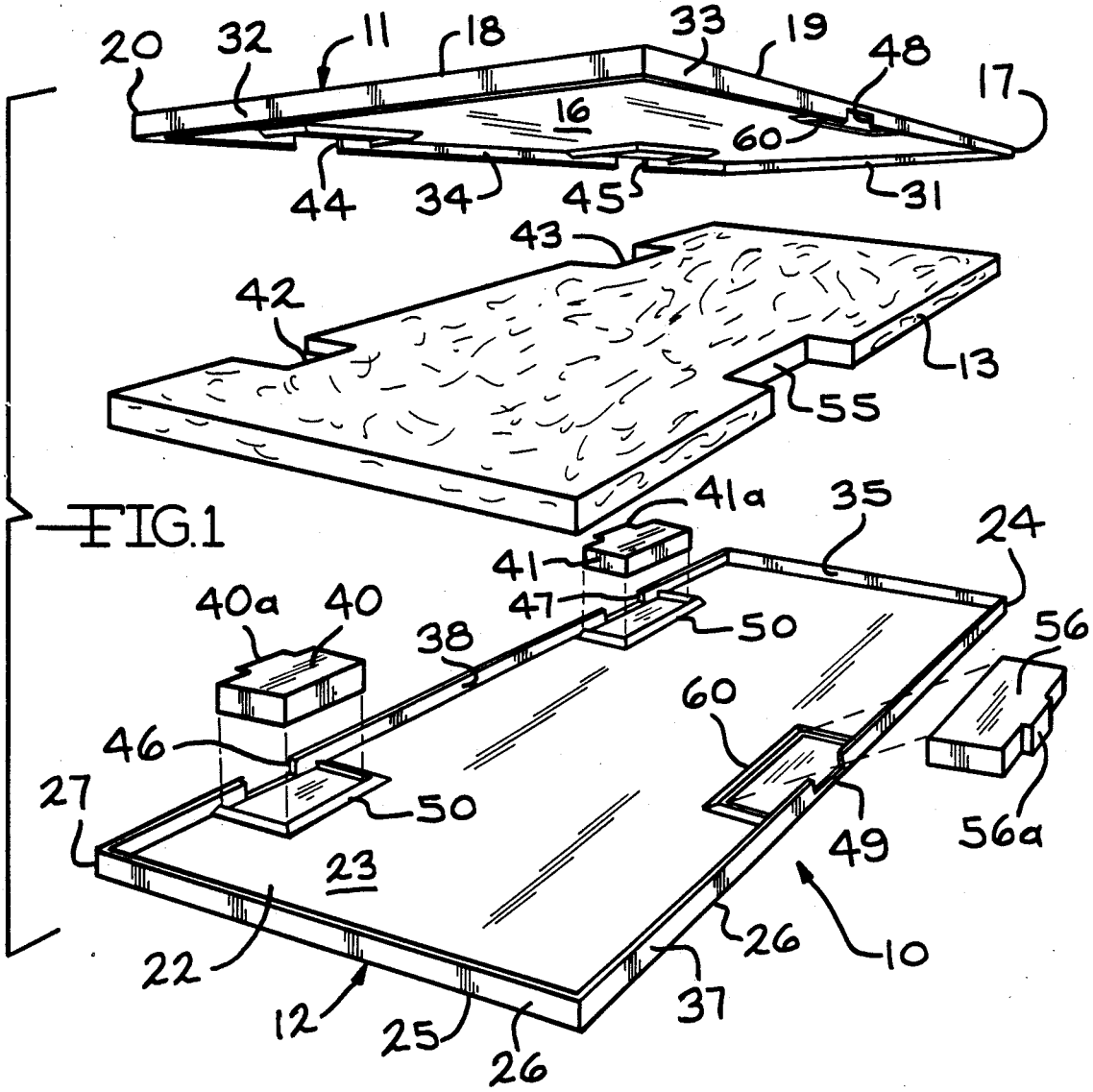
FIG. 1 is an exploded view of one embodiment of a compression molded door assembly according to the present invention and showing one type of core.
Figure 3:
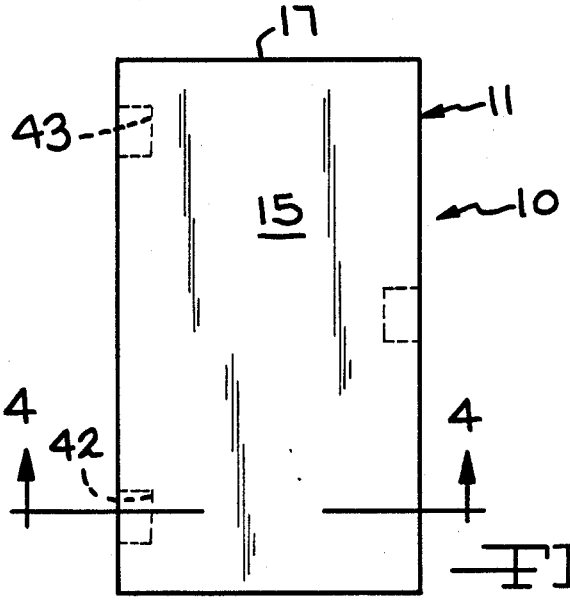
FIG. 3 is an elevational view of a compression molded door assembly, according to the present invention.
Figure 2:
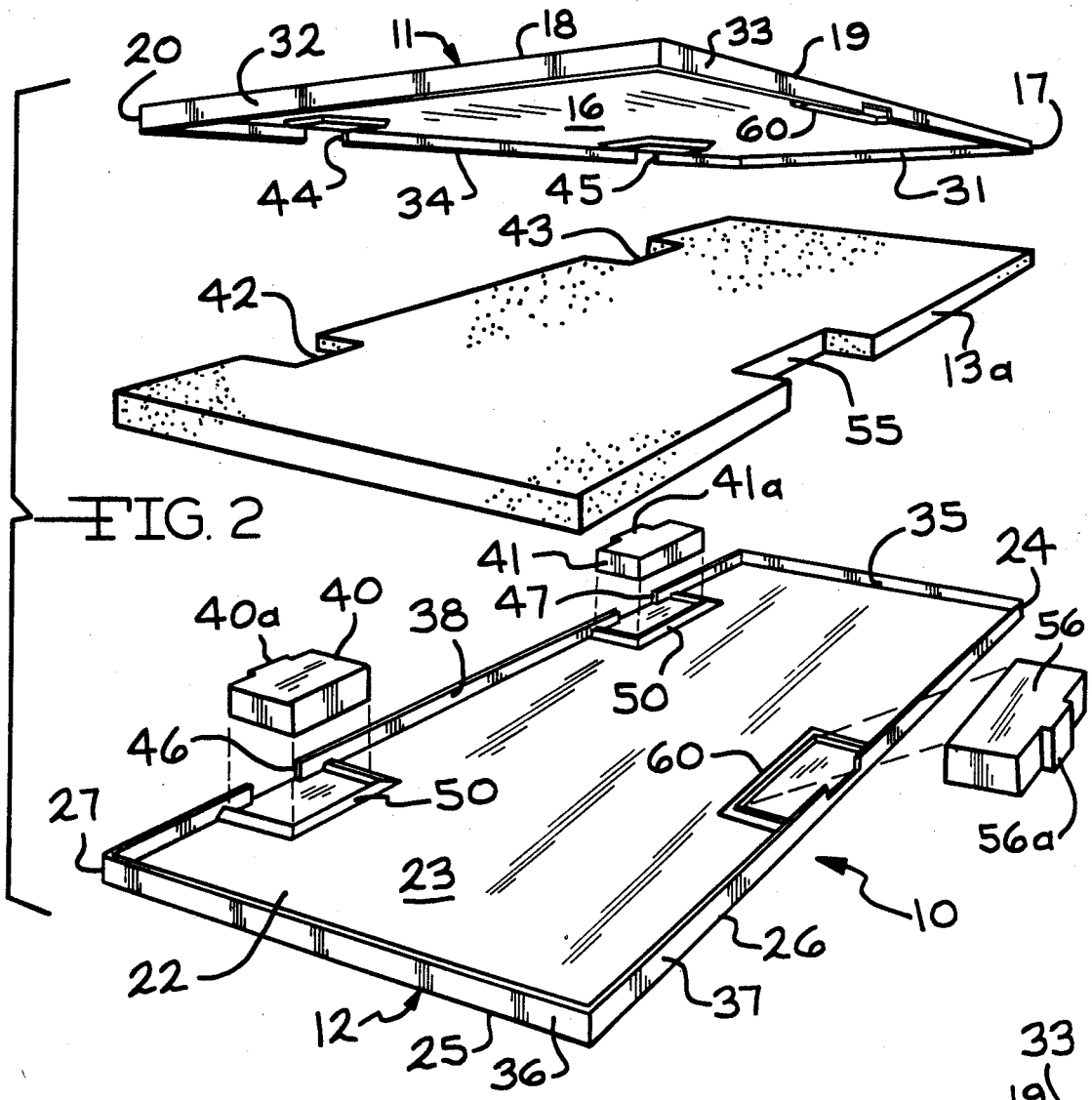
FIG. 2 is an exploded view of another embodiment of the present invention and showing another type of core.

A compression molded door assembly, according to the present invention, is generally indicated by the reference numeral 10 in FIGS. 1 and 3. The compression molded door assembly 10 includes a pair of opposed compression molded door panels or skins 11 and 12. The interior of door assembly 10 is often filled with a foamed core 13 but may be filled with one of many different types of materials including fibrous glass insulation blanket, a rigid formed expanded fibrous glass insulation member as shown at 13*a* in FIG. 2, or loose fibrous glass insulation particles.

Each of the skins 11, 12 is a compression molded sheet molding compound (SMC) panel which includes 15% to 40% fibrous glass reinforcement, by weight, and 10% to 40% inert material filler, by weight, in the molding resin. Unsaturated polyester polymers blended with vinyl monomers such as styrene are molding resins that may be cured under heat and pressure form the thermoset compression molded skins. The molding resins include unsaturated polyester resin compositions and modifications as disclosed in, for examples, U.S. Pat. Nos. 3,772,241, and 3,883,612.

The inert filler may be, for examples, calcium carbonate or aluminum trihydrate. In some embodiments, the material may also include ultraviolet stabilizers and fire retardant additives in the composition.

Each of the skins 11, 12 has a thickness of between 0.050 inch and 0.120 inch. The present embodiment shown in FIG. 1 has a skin thickness of 0.070 inch.

Referring to FIGS. 1 through 4, the compression molded skin 11 has an outer side 15, an inner side 16, top and bottom edges 17, 18 and opposed side edges 19, 20.

Similarly, the compression molded skin 12 has an outer side 22, an inner side 23, a top edge 24, a bottom edge 25 and side edges 26,27.

The outer sides 15 and 22 of the skins 11 and 12 include a molded wood grain texture. The texture is important and simulates from a texture viewpoint and a graining viewpoint a wood door. The texture on the other sides 15 and 22 is between 0.003 inch and 0.009 inch in depth. The outer sides 15 and 22 of the skins 11 and 12 are essentially devoid of glass fibers for a predetermined depth of at least 0.005 inch. The predetermined depth, where the outer sides 15 and 22 are essentially devoid of glass fibers, is normally between 0.005 inch and 0.009 inch.

While the inner sides 16 and 23 of the skins 11 and 12 may also have a defined pattern or random texture molded into the skin, this is not essential to the invention.

If desired, one of the skins, for example, that depicted by the numeral 12, may be formed of materials other than those specified above for forming compression molded skins. For example, if it is not important to have the molded wood grain texture on the outer surface 22 of skin 12, it may be formed of any of a wide variety of plastic materials capable of being extruded or cast such as polyethylene or polycarbonate or it may be formed of metal such as steel or aluminum.

In the embodiment shown, a rectangular wooden or other rectangular frame is not provided. In the present embodiment each of the edges 17, 18, 19, and 20 of the compression molded skin 11 is provided with an integral edge member 31, 32, 33 and 34, which extend outwardly from the edges 17, 18, 19 and 20, respectively, of the door skin 11. Similarly, integral edge members 35, 36, 37 and 38 extend outwardly from the edges 24, 25, 26 and 27, respectively, of the door skin 12.

The integral edge members 34 and 38 have a first set of notches 44 and 46, respectively, which are aligned with each other and a second set of notches 45 and 47, respectively, which are also aligned with each other. The respective set of notches 44 and 46, 45 and 47 are positioned to be aligned with hinges of a mounting structure (not shown). The opposite integral edge members 33 and 37 are also provided with notches 48 and 49 which are aligned with one another and with a door latch retention (not shown).

In order to provide means for hanging the compression molded door assembly in an opening, a pair of mounting blocks 40 and 41 is provided. The mounting blocks 40, 41, which may be formed of wood or other material suitable for retention to hinges by screws or other suitable anchoring means, are positoned between the compression molded skins 11 and 12 adjacent the edge of the door assembly formed by the edges 20 and 27, respectively, of skins 11 and 12. The core 13 or 13*a* is provided with notched areas 42 and 43 along one edge, each of which is sized to snugly receive one of the mounting blocks 40 or 41. The notched area 42 is positioned in alignment with the location of the first set of notches 44 and 46 of the integral edge members 34 and 38 and the notched area 43 is positioned in alignment with the second set of notches 45 and 47.

Mounting block 40 is provided with a projection 40*a* which extends through the first set of notches 44 and 46 and mounting block 41 is provided with a projection 41*a* which extends through the second set of notches 45 and 47.

Additionally, the inner side 16 of skin 11 and inner side 23 of the skin 12 may each be provided with two molded dams 50, each having a size and configuration and so located as to snugly receive one of the mounting blocks 40 and 41. Thus, when the inner and outer door skins 11 and 12 are joined and sealed around the core 13, the mounting blocks 40 and 41 will be retained between the inner surfaces 16 and 23 of the respective door skins 11 and 12 and held in position by one of the dams 50 and the integral edge members 34 and 38 with the projection 40*a* of the mount block 40 extending through the first set of notches 44 and 46 and the projection 41*a* of the mounting block 14 extending through the second set of notches 45 and 47.

Similarly, the opposite edge of the core 13 is provided with a notched area 55 which is sized to receive a door latch retaining mechanism 56. The integral edge members 33 and 37 are provided with notches 48 and 49, respectively which are aligned with each other and with the notched area of the core 13. The door latch retaining mechanism has a projection 56*a* which extends through the aligned notches 48 and 49. Additionally, the inner surface 16 of door skin 11 and inner surface 23 of door skin 12 are each provided with a molded dam 60 which is sized to snugly receive and retain the door latch retaining mechanism 56.

Figure 4:
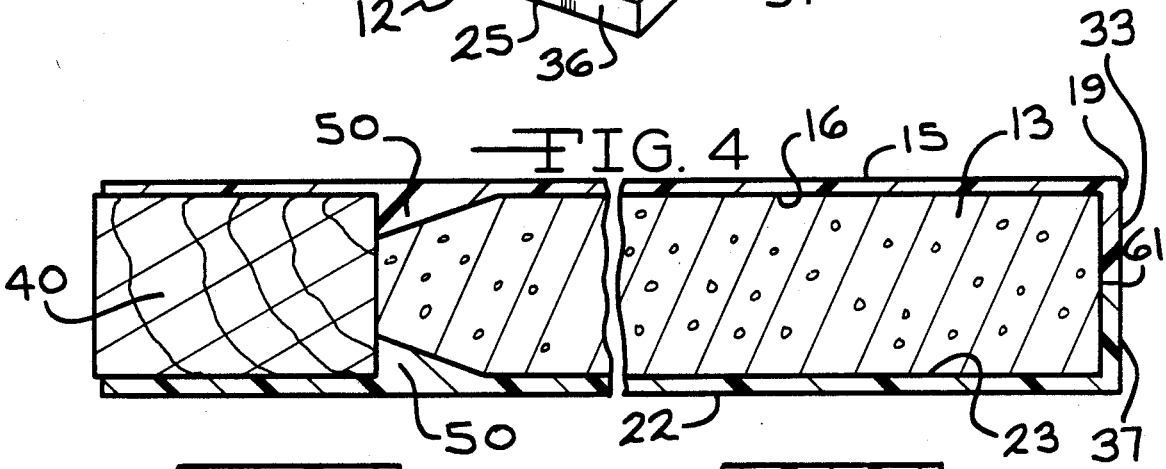
FIG. 4 is a cross-sectional view taken ling the line 4—4 of FIG. 3.

As shown in FIG. 4 the door skins 11 and 12 are joined at a butt joint 61 formed by the abutting ends of the integral edge numbers 33 and 37 (as shown in FIG. 4) and the abutting ends of the other integral and opposing edge members 31 and 35 at the top, 32 and 36 at the bottom, and 34 and 38 along the hinge side of the door. If desired, instead of a butt joint, a lap joint 62 in the form shown in FIG. 5 or FIG. 6 may be provided. Adhesives such as thermosetting contact adhesives may be utilized for adhering the respective members forming the joints.

Figure 7:
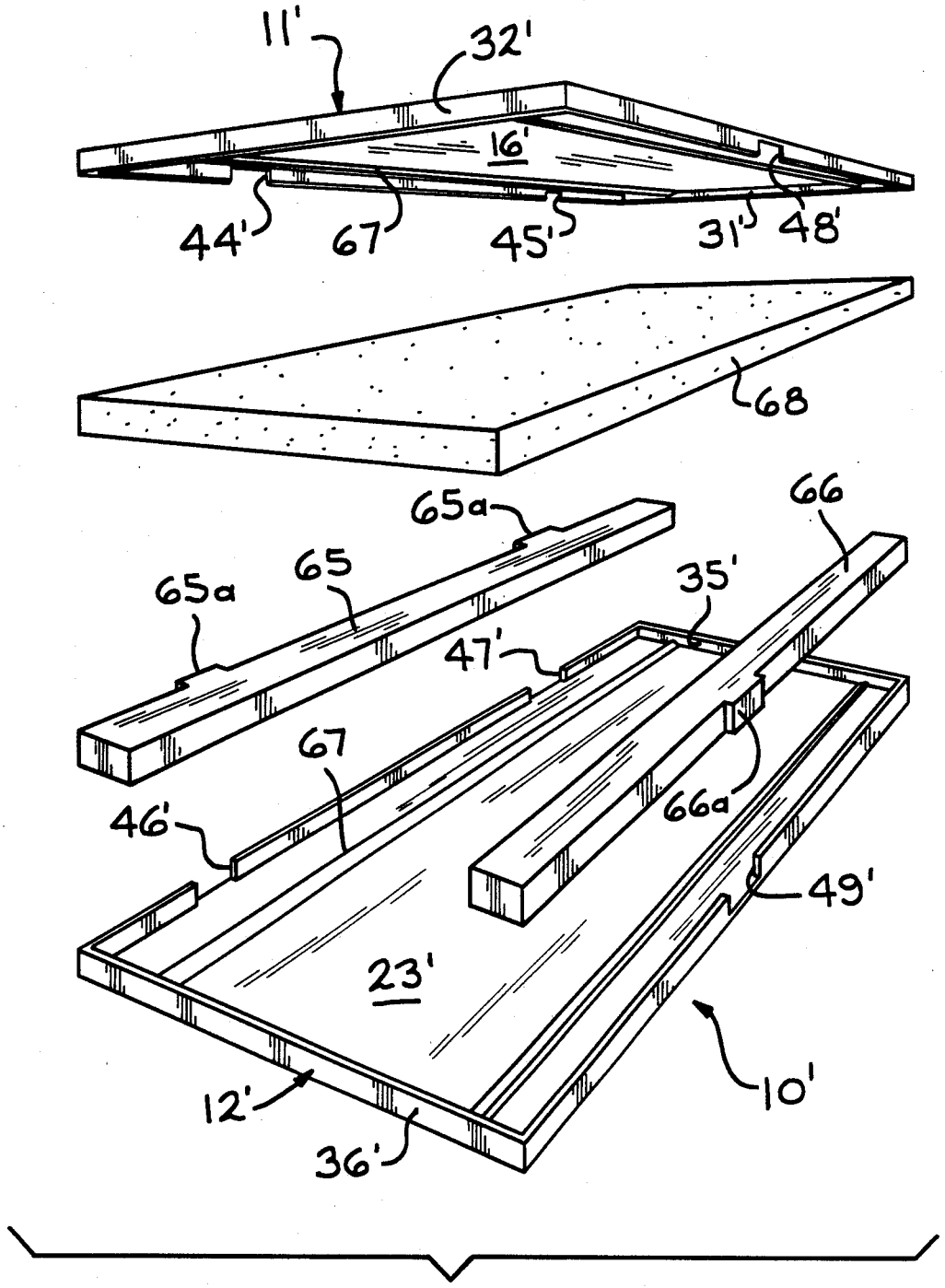
FIG. 7 is an exploded view of another embodiment of the present invention; and, FIG. 8 is an exploded view of yet another embodiment.

Referring now to FIG. 7 there is shown a modified embodiment in which a pair of boards 65 and 66 may be provided along each edge of the door assembly 10'. The board 65 on the hinged side of the door is provided with a pair of projections 65*a* positioned in alignment with the respective sets of notches 44', 46' and 45', 47'. The skins 11' and 12' of the embodiment shown in FIG. 7 have longitudinal walls 67 formed on their inner surfaces 16' and 23' for retaining the board 65 in position.

Similary, the board 66 on the door latch side of the door is provided with projection 66*a* so that the board 66 may receive a door latching mechanism which extends out of the edge of the door for latching in a door frame. The top and bottom skins 11' and 12' respectively, are provided with notches 48' and 49'. respectively, through which the projection 66*a* of the board 66 may extend.

In this embodiment there is provided a core 68 having a simple rectangular configuration. The core 68 fits snugly between the longitudinal walls 67 retaining boards 65 and 66 and abuts the upper end formed by the abutting integral edge members 31' and 35' and the lower integral edge members 32' and 36' and is, of course, positioned snugly between the inner surfaces 16' and 23' of the respective door skins 11' and 12'.

Figure 5:
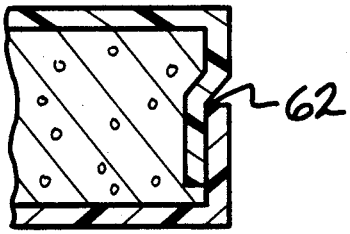
FIG. 5 is a fragmentary cross-sectional view in the area of the right end of line 4—4 of FIG. 3 showing another type of edge construction.
Figure 6:
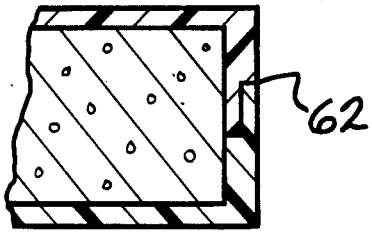
FIG. 6 is a view similar to FIG. 5 showing yet another type of edge construction.
Figure 8:
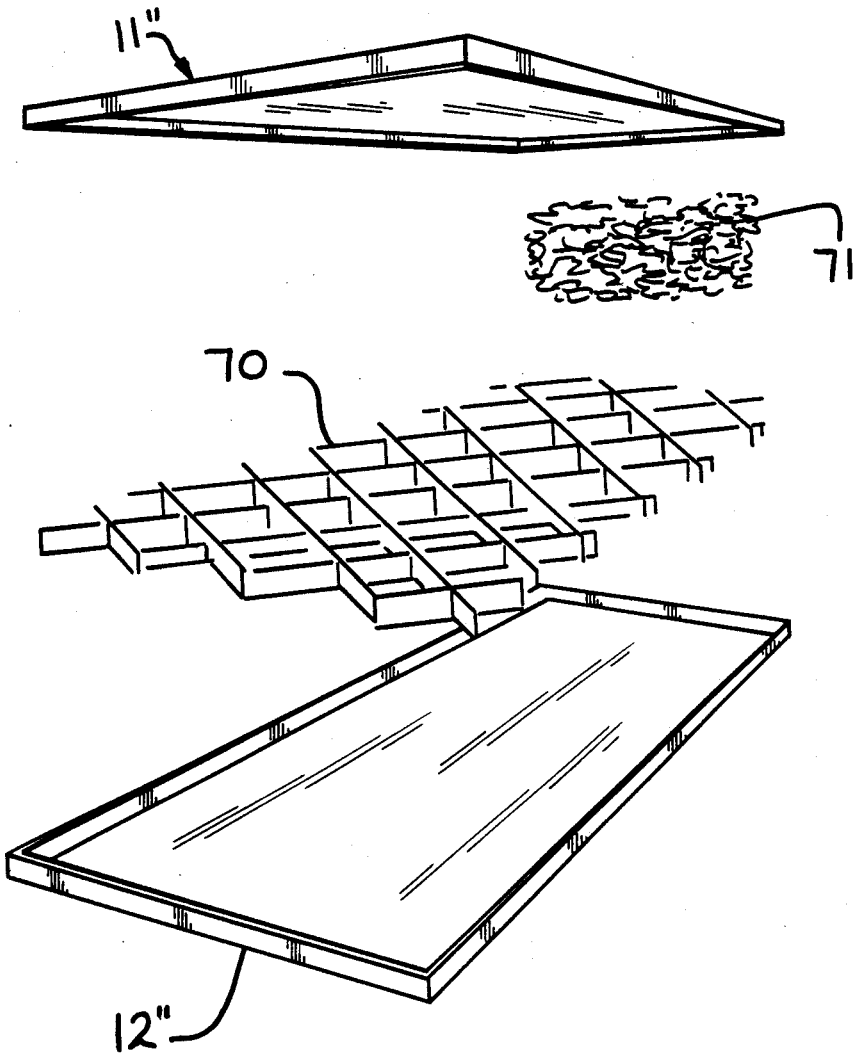

Referring now to FIG. 8 there is shown a modified embodiment in which there is provided a lattice-like core frame 70 which may be formed of molded thermoplastic material or other suitable material for forming a lattice-like structure. In this embodiment a loose pack of fiberous glass filler 71 or similar suitable insulating material is positioned within the openings of the lattice-like structure to provide the insulative feature desired for the door assembly. The edges of the respective upper door skin 11" and 12" are provided with integral edge members and may be sealed in a manner similar to that as shown in FIGS. 4, 5 or 6.

If it is desired to have one of the skins, for example, that depicted by the numeral 12, formed of metal or plastic sheet material, the other skin 11 which is compression molded will be provided with integral edge members 31, 32, 33 and 34 which are sufficiently long to span the full thickness of the core 13 and join the metal or plastic material forming the skin 12.

It can be readily seen that a door of the present invention can be easily and economically assembled with the internal components snugly retained between the respective skins to form a functional and economical door assembly.

While the present invention has been disclosed with respect to the embodiments, it is understood that various changes and modifications may be made to the compression molded door assembly without departing from the scope of the following claims

What I claim:

1. A door assembly comprising, in combination, a pair of skins, each of said skins having an outer side, an inner side, top and bottom edges and opposed side edges, at least one of said skins being integrally compression molded including resin and fibrous glass, the outer side of said compression molded skin defining a textured pattern simulating the grain and texture of a wood door, said compression molded skin having integral edge members extending from each of said top, bottom and side edges at substantially right angles to the plane formed by its inner side, a core positioned between said skins, means for connecting the integral edge members to the other of said skins, means for mounting said door assembly, said side edges having notch means, said mounting means including a pair of side frame members, one positioned adjacent each of said side edges, and having projection means extending into said notch means and retention means integrally molded with and extending from the inner side of said compression molded skin, said retention means sized to receive each of said side frame members.

2. A door assembly comprising, in combination, a pair of skins, each of said skins having an outer side, an inner side, top and bottom edgs and opposed side edges, at least one of said skins being integrally compression molded incuding resin and fibrous glass, the outer side of said compression molded skin defining a textured pattern simulating the grain and texture of a wood door, said compression molded skin having integral edge members extending from each of said top, bottom and side edges at substantially right angles to the plane formed by its inner side, a core positioned between said skins, means for connecting the integral edge member to the other of said skins, means for mounting said door assembly, said side edges having notch means, said mounting means including a pair of mounting blocks positioned between said skins along one of said side edges, and having projection means extending into said notch means and retention means integrally molded with and extending from the inner side of said compression molded skin, said retention means sized to receive each of said mounting blocks, each of said mounting blocks being retained within separate retention means.

* * * * *